US007195197B2

(12) United States Patent
Hsu et al.

(10) Patent No.: US 7,195,197 B2
(45) Date of Patent: Mar. 27, 2007

(54) TECHNIQUES FOR CONTROLLING A FIN WITH UNLIMITED ADJUSTMENT AND NO BACKLASH

(75) Inventors: William W. Hsu, Diamond Bar, CA (US); Robert A. Wiseman, Lancaster, CA (US)

(73) Assignee: HR Textron, Inc., Santa Clarita, CA (US)

( * ) Notice: Subject to any disclaimer, the term of this patent is extended or adjusted under 35 U.S.C. 154(b) by 0 days.

(21) Appl. No.: 11/055,917

(22) Filed: Feb. 11, 2005

(65) Prior Publication Data

US 2007/0007383 A1 Jan. 11, 2007

(51) Int. Cl.
*F42B 10/00* (2006.01)
*F42B 12/20* (2006.01)
*F42B 15/01* (2006.01)

(52) U.S. Cl. ..... 244/3.27; 102/400

(58) Field of Classification Search ..... 244/3.24, 244/3.25, 3.26, 3.27, 3.28, 3.29, 3.3; 102/400, 102/490

See application file for complete search history.

(56) References Cited

U.S. PATENT DOCUMENTS

| | | | | |
|---|---|---|---|---|
| 2,139,193 | A | 12/1938 | Lamothe et al. | 292/252 |
| 2,255,695 | A | 9/1941 | Bull | 403/6 |
| 2,852,210 | A | 9/1958 | Dietrich | 244/215 |
| 2,952,207 | A | 9/1960 | Kamimoto | 244/3.21 |
| 3,001,474 | A | 9/1961 | McLean et al. | 244/3.21 |
| 3,045,779 | A | 7/1962 | Rosenthal | 185/37 |
| 3,093,075 | A | 6/1963 | Garrett et al. | 244/3.24 |
| 3,154,015 | A | 10/1964 | Muller | 244/3.21 |
| 3,182,564 | A | 5/1965 | Sobeck et al. | 91/421 |
| 3,251,278 | A | 5/1966 | Royster | 92/18 |
| 3,578,783 | A | 5/1971 | Loustalet et al. | 185/37 |
| 3,697,019 | A | 10/1972 | Watson | 244/3.29 |
| 3,711,040 | A | 1/1973 | Carver | 244/3.21 |
| 3,753,316 | A | 8/1973 | Savarieau et al. | 49/31 |
| 3,759,466 | A | 9/1973 | Evers-Euterneck | 244/3.21 |
| 3,764,091 | A | 10/1973 | Crowhurst | 244/3.22 |
| 3,787,012 | A | 1/1974 | Jakubowski | 244/137.4 |
| 3,985,213 | A | 10/1976 | Braggins | 192/56.57 |
| 4,120,232 | A | 10/1978 | Hoffman, Jr. | 89/1.51 |

(Continued)

FOREIGN PATENT DOCUMENTS

DE 10207415 A1 2/2002

(Continued)

*Primary Examiner*—Teri Pham Luu
*Assistant Examiner*—Edward J Mayle
(74) *Attorney, Agent, or Firm*—BainwoodHuang

(57) ABSTRACT

A fin control assembly includes a housing, an arm configured to couple to a fin and to steer the fin relative to the housing, and a locking member disposed within the housing. The locking member is configured to (i) lock the arm in a substantially fixed state to inhibit movement of the arm relative to the housing when the locking member is in an engaged position, and (ii) unlock the arm from the substantially fixed state to allow the arm to steer the fin relative to the housing when the locking member moves from the engaged position to a disengaged position. The locking member has a cylindrical body portion and a cylindrical end portion, which is eccentric with the cylindrical body portion, to enable the locking member to lock the arm in the substantially fixed state while the arm holds the fin in a neutral location.

20 Claims, 5 Drawing Sheets

U.S. PATENT DOCUMENTS

| | | | | |
|---|---|---|---|---|
| 4,141,520 | A | 2/1979 | Beijer et al. | 244/224 |
| 4,167,891 | A | 9/1979 | Kamimura | 91/408 |
| 4,173,322 | A | 11/1979 | Macdonald | 244/75 |
| 4,175,720 | A | 11/1979 | Craig | 244/3.28 |
| 4,185,539 | A | 1/1980 | Stratienko | 91/45 |
| 4,240,332 | A | 12/1980 | Deutsch | 92/5 L |
| 4,289,039 | A | 9/1981 | Trummer et al. | 74/2 |
| 4,295,413 | A | 10/1981 | Kamimura | 92/5 L |
| 4,320,914 | A | 3/1982 | Simon | 294/82.28 |
| 4,374,577 | A | 2/1983 | Brown et al. | 244/3.21 |
| 4,441,674 | A | 4/1984 | Holtrop | 244/137.4 |
| 4,470,340 | A | 9/1984 | Goans et al. | 92/29 |
| 4,518,004 | A * | 5/1985 | Hsu et al. | 137/115.18 |
| 4,523,731 | A | 6/1985 | Buitekant et al. | 244/137.4 |
| 4,526,058 | A | 7/1985 | Runkel et al. | 74/531 |
| 4,565,183 | A | 1/1986 | Smith | 124/26 |
| 4,568,041 | A * | 2/1986 | Whitham | 244/3.25 |
| 4,573,725 | A | 3/1986 | Griffiths | 294/82.28 |
| 4,664,339 | A * | 5/1987 | Crossfield | 244/3.28 |
| 4,667,899 | A | 5/1987 | Wedertz | 244/3.24 |
| 4,691,880 | A | 9/1987 | Frank | 244/49 |
| 4,712,471 | A | 12/1987 | Johnson | 92/24 |
| 4,738,412 | A | 4/1988 | Ozunas | 244/3.21 |
| 4,795,110 | A | 1/1989 | Lang | 244/3.24 |
| 4,860,969 | A | 8/1989 | Muller et al. | 244/3.27 |
| 4,951,552 | A | 8/1990 | Fox | 92/27 |
| 4,987,968 | A | 1/1991 | Martus et al. | 180/272 |
| 5,050,484 | A | 9/1991 | Kamimura | 92/5 L |
| 5,056,418 | A | 10/1991 | Granger et al. | 92/24 |
| 5,063,828 | A | 11/1991 | Kamimura | 92/26 |
| 5,081,910 | A | 1/1992 | D'Ascenzo, Jr. | 92/20 |
| 5,095,808 | A | 3/1992 | Baldridge | 92/24 |
| 5,097,748 | A | 3/1992 | Koch et al. | 92/16 |
| 5,114,095 | A | 5/1992 | Schroppel et al. | 244/3.28 |
| 5,127,605 | A | 7/1992 | Atchison et al. | 244/3.27 |
| 5,184,465 | A | 2/1993 | Howard et al. | 60/403 |
| 5,192,037 | A | 3/1993 | Moorefield | 244/46 |
| 5,216,909 | A | 6/1993 | Armoogam | 70/278.7 |
| 5,263,751 | A | 11/1993 | Priest et al. | 292/336.3 |
| 5,349,894 | A | 9/1994 | Greer | 91/43 |
| 5,379,969 | A | 1/1995 | Marx et al. | 244/49 |
| 5,504,408 | A | 4/1996 | Speicher et al. | 318/685 |
| 5,600,977 | A | 2/1997 | Piron | 70/57.1 |
| 5,611,223 | A | 3/1997 | Spitzer | 70/58 |
| 5,628,216 | A | 5/1997 | Qureshi et al. | 70/278.7 |
| 5,904,319 | A | 5/1999 | Hetzer | 244/3.24 |
| 5,950,963 | A | 9/1999 | Speicher et al. | 244/3.21 |
| 6,059,228 | A | 5/2000 | Koizumi et al. | 244/102 R |
| 6,074,140 | A | 6/2000 | Cook | 408/240 |
| 6,125,673 | A | 10/2000 | Luker | 70/276 |
| 6,186,047 | B1 | 2/2001 | Baruffaldi | 92/24 |
| 6,224,013 | B1 | 5/2001 | Chisolm | 244/3.27 |
| 6,250,584 | B1 | 6/2001 | Hsu et al. | 244/3.24 |
| 6,352,217 | B1 | 3/2002 | Hsu et al. | 244/3.24 |
| 6,450,444 | B1 * | 9/2002 | Sorvino | 244/3.24 |
| 6,726,147 | B1 * | 4/2004 | Perini et al. | 244/3.27 |
| 6,832,540 | B2 | 12/2004 | Hart | 92/24 |
| 6,948,685 | B2 | 9/2005 | Hawthorne | 244/129.1 |

FOREIGN PATENT DOCUMENTS

| | | |
|---|---|---|
| JP | 55069306 | 5/1980 |
| WO | WO 02/18867 A1 | 3/2002 |

* cited by examiner

TECHNIQUES FOR CONTROLLING A FIN WITH UNLIMITED ADJUSTMENT AND NO BACKLASH

BACKGROUND

A typical flight control system utilizes control surfaces to control flight direction. In the case of a missile, fins typically provide these control surfaces. In general, movable fins attach to movable shafts which extend from the body of the missile. These fins move in various directions in response to movement of these shafts to control flight.

Manufacturers typically provide devices which lock the fins in place prior to missile launch. Such locking devices hold the fins in rigid and stable positions in order to prevent wear and tear on the drive mechanisms responsible for operating the fin shafts. For example, in the context of a missile positioned on the exterior of an aircraft, the fins of the missile are subjected to high aerodynamic loading prior to launch. Without the use of such locking devices, there is a greater likelihood that such loading will cause distortion and fatigue failures of the drive systems (e.g., motors, crank arms, drive trains, etc.) which are responsible for moving the fin shafts.

One conventional locking device includes, for each movable fin, a pin which locks into a crank arm configured to operate that fin. When the missile is launched (e.g., from an aircraft), the pins retract from the crank arms thus allowing the crank arms to move the fins. To assemble a missile with these conventional locking devices, the manufacturer typically selects and installs pins for locking the fins so that the fins reside as close as possible to their neutral (or ideal) positions for minimal friction and wear, and for high accuracy. In particular, a technician manually choose among multiple pins having different predefined offset ends, and a pin having a particular offset may work for one fin but not all fins of the same missile due to differences in tolerance stack up at each fin. In one conventional situation, the manufacturer provides the technician with a wide assortment of different pins to choose from (e.g., 10 different pins) with each pin having a slightly greater incremental offset.

SUMMARY

Unfortunately, there are deficiencies to the above-described missile assembly approach which involves a technician selecting and installing pins by hand for use in locking missile fins in place prior to launch. For example, the above-described conventional approach often involves the technician using a trial and error, best-fit scheme which is extremely time consuming and inefficient. That is, if one pin having a particular offset does not hold a fin in its neutral position, the technician removes that pin and tries another pin having a different offset. The technician continues this process until the technician finds a suitable pin.

Additionally, the above-described conventional approach requires that the manufacturer provide an assortment of pins having different offsets. This creates an inventory burden on the manufacturer since not all of the pins will be used. Moreover, since selection of the pins is determined during time of assembly, the manufacturer is not able to accurately and reliably forecast the pins that will be used. Accordingly, the manufacturer is discouraged from pre-ordering or making the pins in larger, more-efficient quantities.

Furthermore, the above-described conventional best-fit scheme still poses the potential for imprecise pin installations. For example, there may be a situation where the predefined incremental offsets are too coarse to accommodate a particular fin thus leaving the fin slightly off from its neutral position. In such a situation, the aerodynamic loading on that fin may result in flutter or fatigue failure.

In contrast to the above-described conventional approach to assembling a missile which involves a technician employing a best-fit scheme for installing pins having predefined offsets, embodiments of the invention are directed to techniques for controlling a fin by utilizing an adjustable locking member which is configured to move from an engaged position to a disengaged position relative to an arm that couples to the fin. The locking member has a cylindrical body portion and a cylindrical end portion, which is eccentric with the cylindrical body portion, to enable the locking member (e.g., using rotational adjustments) to lock the arm in a substantially fixed state while the arm holds the fin in a neutral location. Such a locking member provides virtually unlimited adjustment capability to eliminate backlash between the locking member and the arm, and alleviates the need for a manufacturer to provide an assortment of pins having different predefined offsets.

One embodiment of the invention is directed to a fin control assembly which includes a housing, an arm configured to couple to a fin and to steer the fin relative to the housing, and a locking member disposed within the housing. The locking member is configured to move from an engaged position to a disengaged position relative to the arm. In particular, the locking member locks the arm in a substantially fixed state to inhibit movement of the arm relative to the housing when the locking member is in the engaged position. Additionally, the locking member unlocks the arm from the substantially fixed state to allow the arm to steer the fin relative to the housing when the locking member moves from the engaged position to the disengaged position. The locking member has a cylindrical body portion and a cylindrical end portion, which is eccentric with the cylindrical body portion, to enable the locking member to lock the arm in the substantially fixed state while the arm holds the fin in a neutral location. In one arrangement, rotation of the cylindrical body portion enables precise alignment of the arm to the proper fin neutral location. Accordingly, such an assembly enables precise arm control (i.e., robust and reliable fin-shaft locating) with unlimited adjustment and no backlash.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Embodiments of the invention are directed to techniques for controlling a fin by utilizing an adjustable locking member which is configured to move from an engaged position to a disengaged position relative to an arm that couples to the fin. The locking member has a cylindrical body portion and a cylindrical end portion, which is eccentric with the cylindrical body portion, to enable the locking member (e.g., by making rotational adjustments) to lock the arm in a substantially fixed state while the arm holds the fin in a neutral location. Such a locking member provides virtually unlimited adjustment capability to eliminate backlash between the locking member and the arm, and alleviates the need for a manufacturer to provide an assortment of pins having different predefined offsets.

Figure 1:
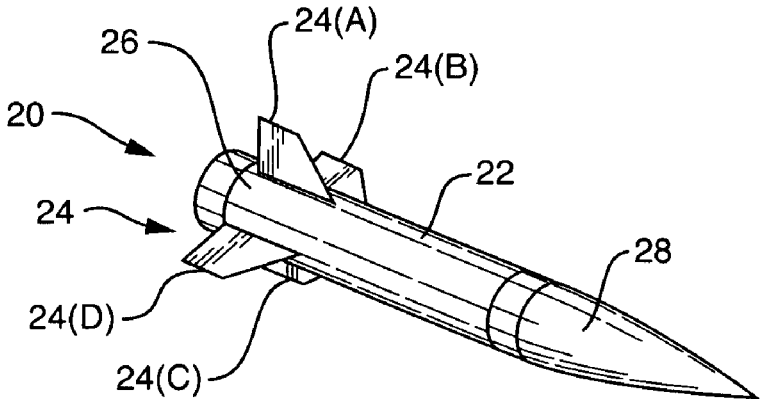
FIG. 1 is a perspective view of a projectile device which is suitable for use by the invention.

FIG. 1 shows a projectile device 20 which is suitable for use by the invention. The projectile device 20 includes a body 22, multiple fins 24 (e.g., see fins 24(A), 24(B), 24(C), 24(D)), multiple fin control assemblies 26 and a payload 28. Both the fin control assemblies 26 and the payload 28 are housed within and carried by the body 22. As will be explained shortly in connection with the other figures, the fin control assemblies 26 utilize adjustable locking members which provide continuous adjustment ranges thus providing a single component design capable of handling any tolerance stack up situation with no backlash.

By way of example, the projectile device 20 is a missile which affixes to the exterior of an aircraft. In this example, the fins 24 are disposed 90 degrees apart around the circumference of the missile. Although four fins 24 are shown, it should be understood that a lesser or greater number may be utilized depending upon the particular type of projectile device 20 and its mission. Missiles for applications similar to that explained above are described in U.S. Pat. Nos. 6,250,584 and 6,352,217, the teachings of which are hereby incorporated by reference in their entirety. Further details of the invention will now be provided with reference to FIG. 2.

Figure 2:
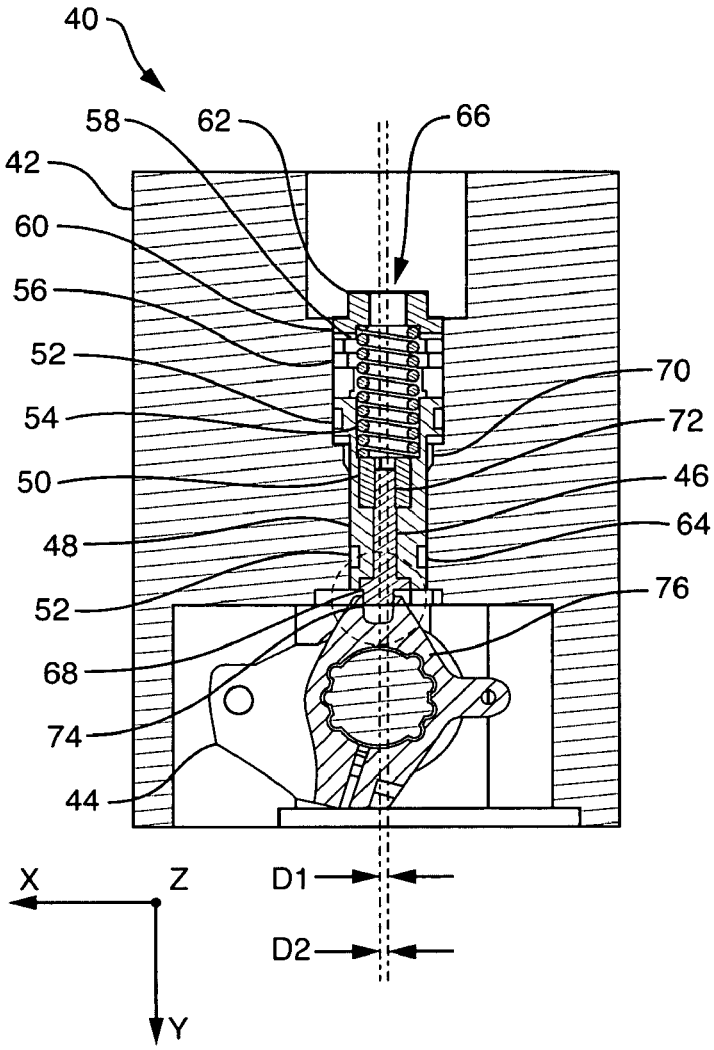
FIG. 2. is a cross-sectional view of a fin control assembly of the projectile device of FIG. 1 when the fin control assembly is in a locked state.

FIG. 2. is a cross-sectional view 40 of a fin control assembly 26 for a fin 24 when fin controlled assembly 26 is in a locked state. The fin control assembly 26 includes a housing 42, an arm 44 and a locking member 46. The housing 42 attaches to the projectile body 22 and the arm 44 couples to a fin 24 (also see FIG. 1).

The fin control assembly 26 further includes a control piston 48, a nut 50, packing 52, a pre-loaded spring 54, a retaining washer 56, a retaining ring 58, a locking wire 60, and a spring cap 62. The housing 42 defines a chamber 64 within which these components reside. The chamber 64 has an installation end 66 and an arm end 68. The housing 42 further defines a fluid port 70 which connects to the chamber 64. Further details of these components and their operation will be provided later.

It should be understood that the locking member 26 includes a body portion 72 and an end portion 74 which is integral with the body portion 72, i.e., as a solid, unitary element. The control piston 48 holds the body portion 72 so that both the control piston 48 and the body portion 72 move together along the Y-axis. The end portion 74 defines a tooth and is configured to engage with and disengage from a notched portion 76 of the arm 44. Further details of how the end portion 74 engages the notched portion 76 of the arm 44 will now be provided with reference to FIG. 3.

Figure 3:
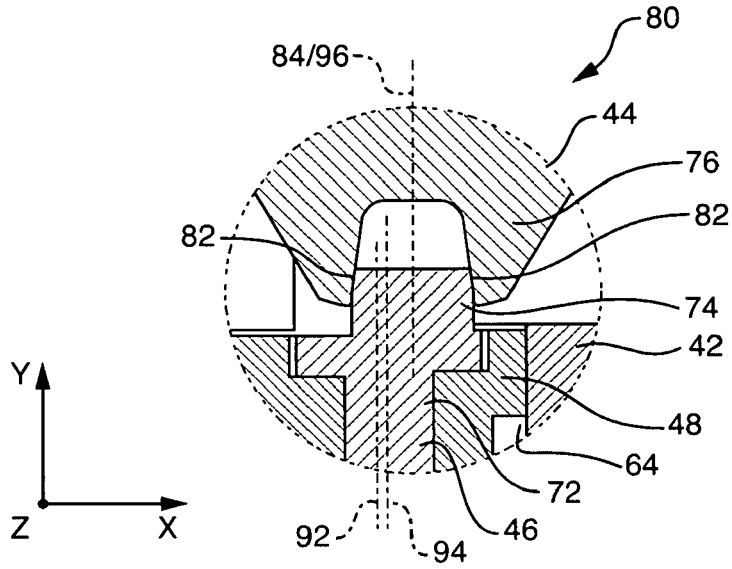
FIG. 3 is a side view of a portion of a locking member of the fin control assembly of FIG. 2 when engaging a notched portion of an arm of the fin control assembly.

FIG. 3 is a side view 80 of the end portion 74 of the locking member 46 when engaging the notched portion 76 of the arm 44 of the fin control assembly 26 of FIG. 2. The end portion 74 defines an involute tooth which tapers toward the notched portion 76. The notched portion 76 defines a V-shaped groove (i.e., two straight surfaces) which widens toward the locking member 46. Accordingly, there is robust contact between the arm 44 and the locking member 46 at points 82. As a result, while the fin control assembly 26 remains in the locked state, there is no backlash between the arm 44 and the locking member 46, and any loading on the fin 24 (also see FIG. 1), which couples to the arm 44, is distributed through the locking member 46 and ultimately into the housing 42 to prevent damaging the driving mechanism which controls positioning of the arm 44 once the arm 44 is unlocked.

At this point, it should be understood that the arm 44 has a fin neutral location 84 in which the fin 24 coupled to the arm 44 lies in an optimal orientation to the projectile body 22 (FIG. 1). From one fin 24 to another and from one fin control assembly 26 to another, subtle differences in particular components and installations may create tolerance stack ups resulting in a different distance between the fin neutral location 84 of an arm 44 for a particular fin 24 and an alignment point of the housing 42 (e.g., the centerline of the chamber 64 defined by the housing). To address this issue, the locking member 46 is configured to rotate within the control piston 48 in order to provide unlimited adjustment capability. Further details of this aspect will now be described with reference to FIG. 4.

Figure 4:
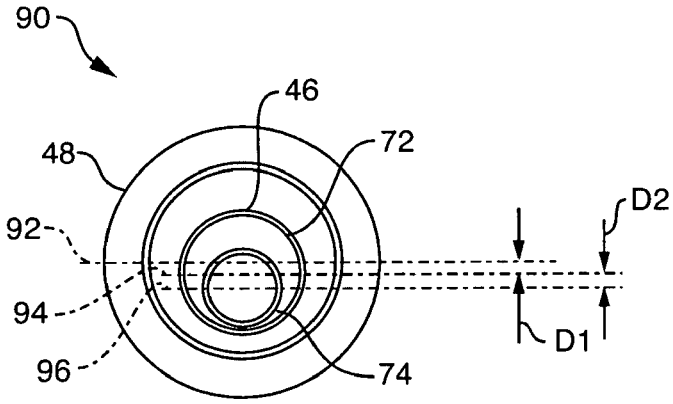
FIG. 4 is a top view of the locking member of FIG. 3.

FIG. 4 is a top view 90 of the locking member 46 and the control piston 48. As shown, the control piston 48 is cylindrical in shape, and has a central axis (or center line) 92. Similarly, the body portion 72 of the locking member 46 is cylindrical in shape, and has a central axis 94. Additionally, the end portion 74 of the locking member 46 is cylindrical in shape, and has a central axis 96. All of the axes 92, 94, 96 are parallel to each other and extend along the along the Y-direction in FIGS. 2 and 3.

As further shown in FIG. 4, the central axis 94 of the cylindrical body portion 72 of the locking member 46 is offset from the central axis 92 of the control piston 48 by a distance D1 (e.g., 0.020 inches). Similarly, the central axis 96 of the cylindrical end portion 74 is offset from the central axis 94 of the cylindrical body portion 72 by a distance D2 (e.g., 0.020 inches).

During installation, the manufacturer has the capability of rotating the locking member 46 within the control piston 48. Moreover, such rotation is capable of occurring while the locking member 46 and the control piston 48 reside within the chamber 64 (FIG. 2), and while the cylindrical end portion 74 contacts the notched portion 76 of the arm (FIG. 3). The locking member 46 is then capable of being set (i.e., fastened) into position relative to the control piston 48 by tightening the nut 50 (FIG. 2). Accordingly, any deviation between the fin neutral location 84 of the arm 44 and a common alignment point on the housing 42 (such as the central axis 92 of the control piston 48 which is also the center line of the chamber 64) is capable of being dealt with by rotating the locking member 46 within the control piston 48.

It should be understood that the locking member 46 is capable of rotating fully within the control piston 48. Accordingly, rotating the locking member 46 over 180 degrees from the orientation shown in FIG. 4 provides an adjustment range of 2*D2, i.e., twice the distance D2 (e.g., 0.040 inches). This adjustment range alleviates the need for the manufacturer to carry pins having different predefined offsets in inventory. Rather, the manufacturer may simply carry a single product (i.e., the combination of the locking member 46 and the control piston 48), and reliably use that product in each fin control assembly 26. Furthermore, installation time is reduced since technicians do not need to waste time test fitting different pins using a trial and error method.

It should be further understood that the combination of the locking member 46 and the control piston 48 provides a continuous (rather than segmented) range of travel. Accordingly, each installation will have precise alignment with the fin neutral location 84 of the arm 44 (FIG. 3) with no backlash. The involute gear curve provided by the cylindrical end portion 74 and the V-shaped groove provided by the notched portion 76 of the arm provides robust engagement between the locking member 46 and the arm 44. As a result, each fin 24 is reliably protected against failure due to any loading on that fin 24 prior to launch since that loading will distribute through the locking member 46 and the control piston 48 into the housing 42 and the projectile body 22. Further details of the invention will now be provided with reference to FIG. 5.

Figure 5:
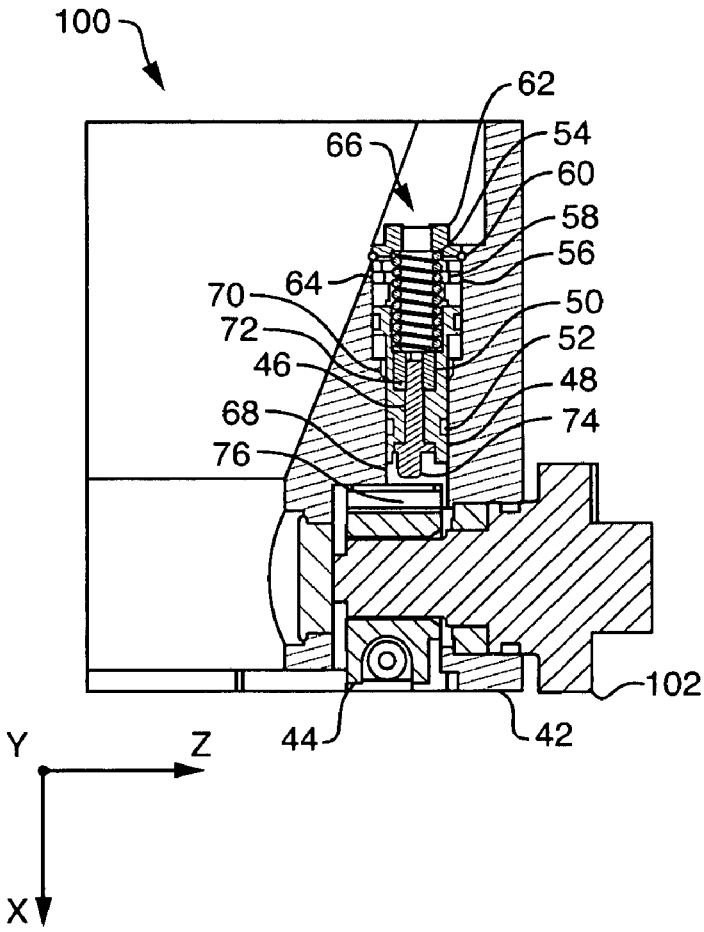
FIG. 5 is a cross-sectional view of the fin control assembly of FIG. 2 when the fin control assembly is in an unlocked state.

FIG. 5 is a cross-sectional view 100 of the fin control assembly 26 when the fin control assembly 26 is in an unlocked state. The cross-section is made at a 90 degree angle to that of FIG. 2 to illustrate some additional features of the fin control assembly 26. For example, as shown in FIG. 5, the V-shaped groove defined by the notched portion 76 of the arm 44 is elongated in a channel-like manner. Also, FIG. 5 illustrates a fin shaft 102 which leads to a fin 24 and which is operated on by the arm 44.

It should be understood that the locking member 46 and the control piston 48 are initially disposed in the engaged position relative to the arm 44 as shown in FIG. 2. With reference temporarily directed back to FIG. 2, the pre-loaded spring 54 provides a force in the positive Y-direction to bias the locking member 46 and the control piston 48 toward the arm 44 to hold the locking member 46 in the engaged position. While the locking member 46 is in this engaged position, the cylindrical end portion 74 contacts the notched portion 76 of the arm 44 to prevent the arm 44 from moving. The locking wire 60 provides a detent for the spring cap 62. The spring cap 62 fits over the end 66 to contain the various components within the housing chamber 64. At this point, the fin control assembly 26 is ready for operation.

To operate the fin control assembly 26, highly pressurized fluid (e.g., either gas or liquid under 300 PSI) enters through the fluid port 70 and provides force in the opposite direction to that of the force provided by the spring 54. There is only low friction between the control piston 48 and the housing 42, e.g., due to a minute amount of friction provided by the packing 52 which provides a pressure seal between the control piston 48 and the housing 42 and due to the absence of any scraper. Accordingly, as soon as the force from the fluid exceeds the spring force, the control piston 48 quickly moves away from the arm 44 in the negative Y-direction and into the disengaged position as shown in FIG. 5.

As the control piston 48 moves away from the arm 44, the retaining ring 58 captures the end of the control piston 48 (FIG. 5) thus holding the control piston 48 and the locking member 46 in the disengaged position. In particular, the retaining ring 58 provides a small angled slope that allows the control piston 48 to push through but not let the control piston 48 move backward. Accordingly, the locking member 46 will not inadvertently re-engage the arm 44.

Figure 6:
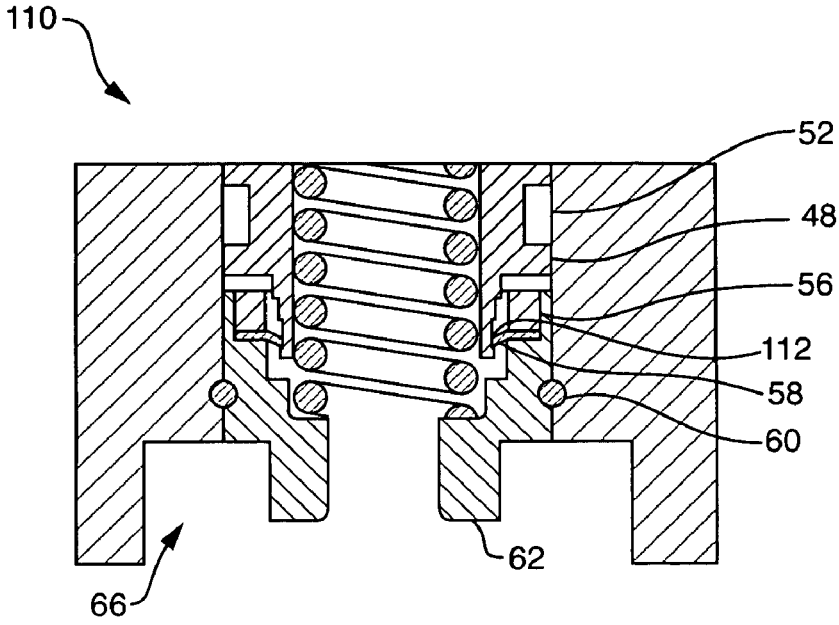
FIG. 6 is a detailed cross-sectional view of a portion of the fin control assembly when the fin control assembly is permanently locked in the unlocked state.

FIG. 6 shows a detailed cross-sectional view 110 of a portion of the fin control assembly 26 while the retaining washer 56 and the retaining ring 58 hold the control piston 48. In this situation, the control piston 48 and the locking member 46 will not release from the disengaged position and interfere with the arm 44. Specifically, the retaining ring 58 is rigidly held in place at its proper location at the end 66 of the chamber 64 by the retaining washer. Furthermore, the retaining ring 58 is sized to provide a robust friction fit 112 with the control piston 48 that prevents the control piston 48 from escaping.

As mentioned above, embodiments of the invention are directed to techniques for controlling a fin 24 by utilizing an adjustable locking member 26 which is configured to move from an engaged position (FIG. 2) to a disengaged position (FIG. 5) relative to an arm 44 that couples to the fin 24. The locking member 26 has a cylindrical body portion 72 and a cylindrical end portion 76, which is eccentric with the cylindrical body portion 72, to enable the locking member 26 (e.g., by making rotational adjustments) to lock the arm 44 in the substantially fixed state while the arm 44 holds the fin 24 in a neutral location 84. Such a locking member 26 provides virtually unlimited adjustment capability to eliminate backlash between the locking member 26 and the arm 44, and alleviates the need for a manufacturer to provide an assortment of pins having different predefined offsets.

While this invention has been particularly shown and described with references to preferred embodiments thereof, it will be understood by those skilled in the art that various changes in form and details may be made therein without departing from the spirit and scope of the invention as defined by the appended claims.

For example, the projectile device 20 was described above as being a missile by way of example only. It should be understood that, in other arrangements, the projectile device 20 is a device other that a missile such as an aircraft or watercraft which requires fins 24 to be held in a stationary position prior to operation.

It should be further understood that the fin control assembly 24 is well-suited for an assembly test procedure in which a relatively small force is applied to the control piston 48 to move the locking member 46 out of engagement with the arm 44. By setting the magnitude of the force to be substantially smaller than that provided by the high pressure fluid, and due to the location of the retaining ring 58 at the end 66 of the chamber 64, the control piston 48 will have a short stroke and thus not be captured by the retaining ring 58 during testing. Such enhancements and modifications are intended to belong to various embodiments of the invention.

What is claimed is:

1. A fin control assembly, comprising:

a housing;

an arm configured to couple to a fin and steer the fin relative to the housing; and a locking member disposed within the housing, the locking member being configured to move from an engaged position to a disengaged position relative to the arm; the locking member (i) locking the arm in a substantially fixed state to inhibit movement of the arm relative to the housing when the locking member is in the engaged position and (ii) unlocking the arm from the substantially fixed state to allow the arm to steer the fin relative to the housing when the locking member moves from the engaged position to the disengaged position; the locking member having a cylindrical body portion and a cylindrical end portion, which is eccentric with the cylindrical body portion, to enable the locking member to lock the arm in the substantially fixed state while the arm holds the fin in a neutral location.

2. The fin control assembly of claim 1 wherein the locking member is configured to rotate around a long axis of the cylindrical body for adjustment of the locking member relative to the arm while the locking member is in the engaged position.

3. The fin control assembly of claim 2 wherein the cylindrical end portion of the locking member defines a tooth which is configured to engage a notch portion in the arm, and wherein the tooth has an involute profile.

4. The fin control assembly of claim 1, further comprising:

a spring disposed within the housing, the spring being configured to provide a spring force on the locking member to bias the locking member toward the arm and into the engaged position.

5. The fin control assembly of claim 4 wherein the locking member is configured to move away from the arm in response to a counter force once the counter force exceeds the spring force provided by the spring.

6. The fin control assembly of claim 1, further comprising:

a control piston which is disposed within the housing and which holds the locking member, the control piston being eccentric with the cylindrical body portion of the locking member, the control piston being configured to move within the housing away from the arm to transfer the locking member from the engaged position to the disengaged position.

7. The fin control assembly of claim 6, further comprising:

a locking ring disposed in a fixed location within the housing, the locking ring being configured to capture the control piston when the locking member moves from the engaged position to the disengaged position.

8. The fin control assembly of claim 6 wherein the housing defines a fluid port which is configured to provide fluid under pressure to move the control piston away from the arm to transfer the locking member from the engaged position to the disengaged position.

9. A projectile device, comprising:

a body configured to carry a payload;

a fin; and a fin control assembly which couples the fin to the body, the fin control assembly including:

a housing attached to the body;

an arm configured to couple to a fin and steer the fin relative to the housing; and a locking member disposed within the housing, the locking member being configured to move from an engaged position to a disengaged position relative to the arm; the locking member (i) locking the arm in a substantially fixed state to inhibit movement of the arm relative to the housing when the locking member is in the engaged position and (ii) unlocking the arm from the substantially fixed state to allow the arm to steer the fin relative to the housing when the locking member moves from the engaged position to the disengaged position; the locking member having a cylindrical body portion and a cylindrical end portion, which is eccentric with the cylindrical body portion, to enable the locking member to lock the arm in the substantially fixed state while the arm holds the fin in a neutral location.

10. The projectile device of claim 9 wherein the locking member is configured to rotate around a long axis of the cylindrical body for adjustment of the locking member relative to the arm while the locking member is in the engaged position, wherein the cylindrical end portion of the locking member defines a tooth which is configured to engage a notch in the arm, and wherein the tooth has an involute profile.

11. The projectile device of claim 9 wherein the fin control assembly further includes:

a control piston which is disposed within the housing and which holds the locking member, the control piston being eccentric with the cylindrical body portion of the locking member, the control piston being configured to move within the housing away from the arm to transfer the locking member from the engaged position to the disengaged position.

12. A method of controlling a fin, the method comprising:

providing an assembly having (i) a housing and (ii) an arm which couples to the fin, the arm being configured to steer the fin relative to the housing;

installing a locking member within the assembly, the locking member being configured to move from an engaged position to a disengaged position relative to the arm, the locking member (i) locking the arm in a substantially fixed state to inhibit movement of the arm relative to the housing when the locking member is in the engaged position and (ii) unlocking the arm from the substantially fixed state to allow the arm to steer the fin relative to the housing when the locking member is in the disengaged position; the locking member having a cylindrical body portion and a cylindrical end portion, which is eccentric with the cylindrical body portion and which is configured to contact a notched portion of the arm, to enable the locking member to lock the arm in the substantially fixed state while the arm holds the fin in a neutral location; and moving the locking member from the engaged position to the disengaged position to allow the arm to steer the fin.

13. The method of claim 12 wherein installing the locking member includes:

rotating the locking member around a long axis of the cylindrical body.

14. The method of claim 13 wherein the cylindrical end portion of the locking member defines a tooth which is configured to engage a notch portion in the arm, and wherein the tooth has an involute profile, and wherein rotating the locking member includes:

turning the locking member while the tooth contacts the notch portion in the arm to adjust the locking member to operate while the arm holds the fin in the neutral location.

15. The method of claim 12 wherein installing the locking member includes:

disposing a spring within the housing, the spring being configured to provide a spring force on the locking member to bias the locking member toward the arm and into the engaged position.

16. The method of claim 15 wherein moving the locking member includes:

applying a counter force in a direction which is opposite the spring force provided by the spring, the counter force moving the locking member away from the arm once the counter force exceeds the spring force provided by the spring.

17. The method of claim 12 wherein installing the locking member includes:

inserting a control piston into the housing, the control piston holding the locking member, the control piston being eccentric with the cylindrical body portion of the locking member, the control piston being configured to move within the housing away from the arm to transfer the locking member from the engaged position to the disengaged position.

18. The method of claim 17 wherein installing the locking member further includes:

disposing a locking ring in a fixed location within the housing, the locking ring being configured to capture the control piston when the locking member moves from the engaged position to the disengaged position.

19. The method of claim 17 wherein the housing defines a fluid port, and wherein moving the locking member includes:

providing fluid under pressure through the port to move the control piston holding the locking member away from the arm to transfer the locking member from the engaged position to the disengaged position.

20. A method of installing a locking member within an assembly configured to control a fin, the assembly having (i) a housing and (ii) an arm which couples to the fin and which is configured to steer the fin relative to the housing, the method comprising:

positioning the locking member within the housing, the locking member being configured to move from an engaged position to a disengaged position relative to the arm, the locking member (i) locking the arm in a substantially fixed state to inhibit movement of the arm relative to the housing when the locking member is in the engaged position and (ii) unlocking the arm from the substantially fixed state to allow the arm to steer the fin relative to the housing when the locking member is in the disengaged position; the locking member having a cylindrical body portion and a cylindrical end portion, which is eccentric with the cylindrical body portion, to enable the locking member to lock the arm in the substantially fixed state while the arm holds the fin in a neutral location;

rotating the locking member around a long axis of the cylindrical body to adjust the locking member to operate while the arm holds the fin in the neutral location, the cylindrical end portion contacting a notched portion of the arm as the locking member rotates; and disposing a spring within the housing, the spring being configured to provide a spring force on the locking member to bias the locking member toward the arm and into the engaged position.

* * * * *